US006397534B1

(12) United States Patent
Hager et al.

(10) Patent No.: US 6,397,534 B1
(45) Date of Patent: Jun. 4, 2002

(54) COVER MEMBER LOCK FOR PARTITION PANELS

(75) Inventors: Allen C. Hager, Grand Rapids; Steven F. Goodman, Wyoming, both of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/592,301

(22) Filed: Jun. 12, 2000

(51) Int. Cl.[7] ..... E04H 1/00

(52) U.S. Cl. ..... 52/239; 52/36.1; 52/511; 160/351; 292/134; 292/236

(58) Field of Search ..... 52/239, 36.1, 243, 52/483.1, 489.1, 474, 506.05, 508, 511, 512; 160/351, 135; 292/11, 52, 200, 100, 134, 236

(56) References Cited

U.S. PATENT DOCUMENTS

| | | | | | |
|---|---|---|---|---|---|
| 4,450,970 | A | | 5/1984 | Shepherd | 211/189 |
| 4,679,368 | A | | 7/1987 | Pettinga et al. | 52/36 |
| 4,683,622 | A | | 8/1987 | Oehlke | 24/458 |
| 4,704,835 | A | | 11/1987 | Jordan | 52/486 |
| 4,928,467 | A | | 5/1990 | Hintsa | 52/511 |
| 5,063,715 | A | * | 11/1991 | Goodman | 52/36 |
| 5,351,740 | A | | 10/1994 | Hanna | 160/135 |
| 5,412,912 | A | | 5/1995 | Alves | 52/36.5 |
| 5,791,093 | A | | 8/1998 | Diamond | 52/36.5 |
| 5,899,025 | A | | 5/1999 | Casey et al. | 52/36.1 |
| 5,899,035 | A | * | 5/1999 | Waalkes et al. | 52/239 |
| 5,921,044 | A | | 7/1999 | Holztrager | 52/483.1 |
| 5,950,371 | A | | 9/1999 | Rives et al. | 52/36.6 |
| 5,996,294 | A | | 12/1999 | Forslund, III et al. | 52/220.5 |
| 6,003,275 | A | | 12/1999 | Cornell et al. | 52/239 |
| 6,082,065 | A | * | 7/2000 | Feldpausch | 52/239 |

* cited by examiner

*Primary Examiner*—Carl D. Friedman
*Assistant Examiner*—Naoko Slack
(74) *Attorney, Agent, or Firm*—Price, Heneveld, Cooper, DeWitt & Litton

(57) ABSTRACT

A cover member for room partitions having a frame with at least one slotted cross-member. The cover member includes a pivoting lock member having a protruding lock tab shaped for reception in a slot in a slotted cross-member of a frame. A connecting member rotatably connects the lock member to a surface of the cover member in a manner which permits the lock member to be rotated about a center of rotation between an insertion position wherein the lock tab is in registry with the cross-member slot and an engaged position wherein the lock tab is engaged with the cross-member to positively yet removably lock the cover member on the frame. The lock member is set up such that the lock tab has a smaller lateral displacement from the center of rotation of the pivoting lock member in the engaged position than in the insertion position. At least one frictional member is configured to be connected to the cover member and extend through the pivoting lock member to frictionally hold the pivoting lock member in position.

30 Claims, 7 Drawing Sheets

COVER MEMBER LOCK FOR PARTITION PANELS

BACKGROUND OF THE INVENTION

The present invention relates to the finishing or fitting-out of building space and the like of the type having a generally open plan interior, and in particular to a furniture post that is readily fitted at the installation site.

The finishing or fitting-out of building spaces for offices, medical treatment facilities, and other areas where work is conducted has become a very important aspect of effective space planning and layout. Work patterns, technology, and business organizations are constantly evolving and changing. The building space users require products which facilitate change at lower cost, yet provide the privacy and aesthetic advantages of permanent floor-to-ceiling architectural wall systems. Space planning is no longer a static problem. Changing technology and changing work processes demand that a design and installation be able to support and anticipate change.

These space planning challenges are driven largely by the fact that modern office spaces are becoming increasingly more complicated and sophisticated due to increasing needs of the users for improved utilities support at each workstation or work setting. These "utilities," as the term is used herein, encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems are also highly desirable to maximize worker creativity and productivity. Many other types of high technology equipment and facilities are also presently being developed which will need to be accommodated in the work places of the future.

The efficient use of building floor space is also an ever-growing concern, particularly as building costs continue to escalate. Open office plans have been developed to reduce overall office costs, and generally incorporate large, open floor spaces in buildings that are equipped with modular furniture systems, which are readily reconfigurable to accommodate the ever-changing needs of a specific user, as well as the divergent requirements of different tenants. One arrangement commonly used for furniture open plans includes movable partial height partition panels that are detachably interconnected to partition off the open spaces into individual work settings and/or offices. Such partial height partition panels are configured to receive hang-on furniture units, such as worksurfaces, overhead cabinets, shelves, etc., and are generally known in the office furniture industry as "systems furniture." Another arrangement for dividing and/or partitioning open plans involves the use of modular furniture, in which a plurality of differently shaped, complementary freestanding furniture units are positioned in a side-by-side relationship, with upstanding partial height privacy screens available to attach to selected furniture units to create individual, distinct work settings and/or offices. All of these types of modular furniture systems have been widely received due largely to their ability to be readily reconfigured and/or moved to a new site, since they are not part of a permanent leasehold improvement.

In order to gain increased efficiency in the use of expensive office real estate, attempts are now being made to try to support highly paid knowledge workers with these types of modular furniture systems in open office settings, instead of conventional private offices. However, in order to ensure peak efficiency of such knowledge workers, the work settings must be equipped with the various state-of-the-art utilities and facilities discussed above. Since such work settings must be readily reconfigurable to effectively meet ever-changing needs, distribution and control of utilities throughout a comprehensive open office plan has emerged as a major challenge to the office furniture industry. The inherent nature of modular furniture systems, which permits them to be readily reconfigurable into different arrangements, makes it very difficult to achieve adequate utility distribution and control.

Today's office workers need new flexible alternative products for the creation of individual and collaborative spaces which allow the expression of the cultural aims of the organization, express the creativity of the designer, provide a "sense of place" for the users, and provide a competitive edge for the developer. These needs include a full range of privacy options, from fully enclosed offices which support individual creative work to open spaces for collaborative team work. The products must also be able to accommodate diverse organizations, unique design signatures, and constantly changing work processes. Workers also need effective lighting, better air quality, life safety, and ergonomic task support to promote productivity, minimize the expenses of absenteeism and workman's compensation, and reduce potential liability, which collectively make the building more desirable to prospective clients.

Hence, utility distribution and control are fast becoming one of the major issues in office fit-out and furniture. Changing technology is creating greater demands on power and signal distribution networks. As businesses become more aware of the impact of proper ventilation and climate control on employee health and performance, HVAC is becoming more important as well. The current disposition of HVAC, lighting, and fire protection in the ceiling creates a separation between these services and the work settings below leading to inefficient and inaccurate systems. Routing power and signal distribution below the floor or in furniture systems often ends up in complex idiosyncratic systems which are difficult to manage or change.

Due to dimension variations in existing permanent building walls, ceiling, and floors, space-dividing systems must be adaptable to accommodate these variables. There is presently an oversupply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology. The refurbishing of existing building space is therefore a concern which must be addressed by furniture systems.

One of the existing partition systems includes a partition having a frame with a slotted frame cross-member and a cover member configured to enclose at least a portion of the frame. These cover members have either been easily removable from the frame or securely locked to the frame. When the cover members are easily removable, wide cover members may tend to rattle or bow, particularly weight supporting slatwall cover members when under load. When the cover members bow, the side edges of the cover member cease being flush with the frame, thereby detracting from the overall aesthetics of the partition system. While through fasteners help correct these problems, they are considered unsightly, and also detract from the overall aesthetics of the partition system. On the other hand, when the cover members are securely locked to the frame, the cover members are not easily replaceable with alternative cover members that include decorations or a different utility than the originally used cover member.

Accordingly, an apparatus solving the aforementioned disadvantages and having the aforementioned advantages is desired.

SUMMARY OF THE INVENTION

One aspect of the present invention is to provide a partition for spatially dividing open building space and the like including a frame having at least one slotted frame cross-member, a cover member, a pivoting lock member and a connecting member. The cover member has a rear surface, and is configured to enclose at least a portion of the frame. The pivoting lock member has a protruding lock tab shaped for reception in an associated slot in the frame cross-member. The connecting member rotatably connects the lock member to a surface of the cover member in a manner which permits the lock member to be rotated about a center of rotation between an insertion position wherein the lock tab is in registry with the cross-member slot and an engaged position wherein the lock tab is engaged with the frame cross-member to positively yet removably lock the cover member on the frame. The partition is configured such that the lock tab has a smaller lateral displacement from the center of rotation of the pivoting lock member in the engaged position than in the insertion position.

Another aspect of the present invention is to provide a partition for spatially dividing open building space and the like including a frame having at least one slotted frame cross-member, a cover member, a lock member and a connecting member. The cover member has a front surface and a rear surface, and is configured to enclose at least a portion of the frame. The lock member has a protruding lock tab shaped for reception in an associated slot in the frame cross-member. The connecting member movably connects the lock member to the rear surface of the cover member in a manner which permits the lock member to be shifted between an insertion position wherein the lock tab is in registry with the cross-member slot and an engaged position wherein the lock tab is engaged with the frame cross-member to positively yet removably lock the cover member on the frame. The cover member includes an access window shaped to allow a tool to be inserted into the access window from the front surface of the cover member and engage the lock member to shift the lock member between the insertion position and the engaged position.

Yet another aspect of the present invention is to provide a lock mechanism for removably attaching a partition cover member to an associated frame having a pivoting lock member, a connecting member and at least one frictional member. The pivoting lock member has a protruding lock tab shaped for reception in an associated slot in the frame cross-member. The connecting member is for rotatably connecting the lock member to a surface of the cover member in a manner which permits the lock member to be rotated about a center of rotation between an insertion position wherein the lock tab is in registry with the cross-member slot and an engaged position wherein the lock tab is engaged with the frame cross-member to positively yet removably lock the cover member on the frame. The at least one frictional member is configured to be connected to the cover member and extending through the pivoting lock member. The lock mechanism is configured such that the frictional member frictionally holds the pivoting lock member in position when the lock tab is received with the associated slot in the frame cross-member, thereby connecting the lock tab with the frame cross-member to positively yet removably lock the cover member to the frame cross-member.

The principal objects of the present invention include providing a lock mechanism for positively yet removably locking a cover member to a frame. The lock mechanism allows the cover member to be easily and quickly locked to and unlocked from the frame. The lock mechanism further allows the cover member to be removably connected to the frame. The cover member with the lock mechanism having a wide length will not bow outward, particularly when the cover member is a slatwall under load. The lock mechanism also provides that the cover member will have side edges flush with the side edges of the frame. The frame with the cover member can therefore be easily and quickly assembled and disassembled. The lock mechanism is efficient in use, economical to manufacture, capable of a long operable life, and particularly adapted for the proposed use.

These and other features, advantages aid objects of the present invention will be further understood and appreciated by those skilled in the art by reference to the following specification, claims and appended drawings.

DETAILED DESCRIPTION OF THE PREFERRED EMBODIMENT

Figure 1:
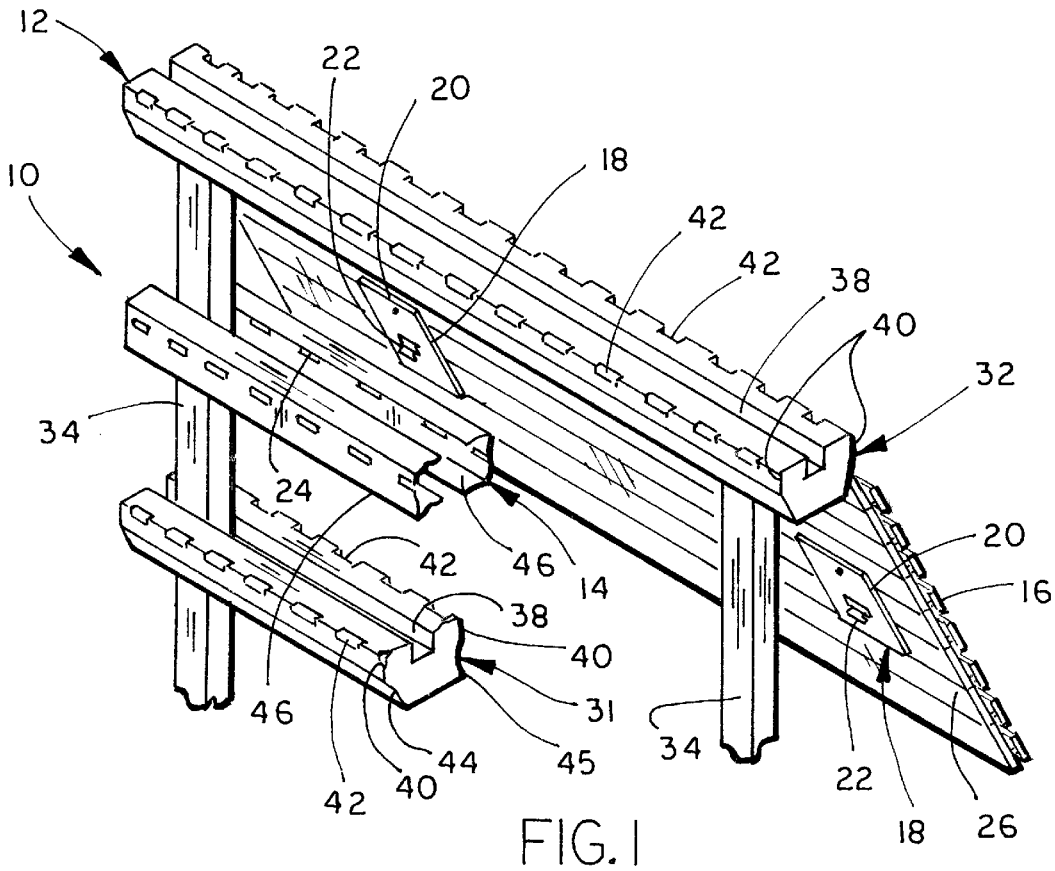
FIG. 1 is a rear perspective view of a partition panel and a cover member embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 7:
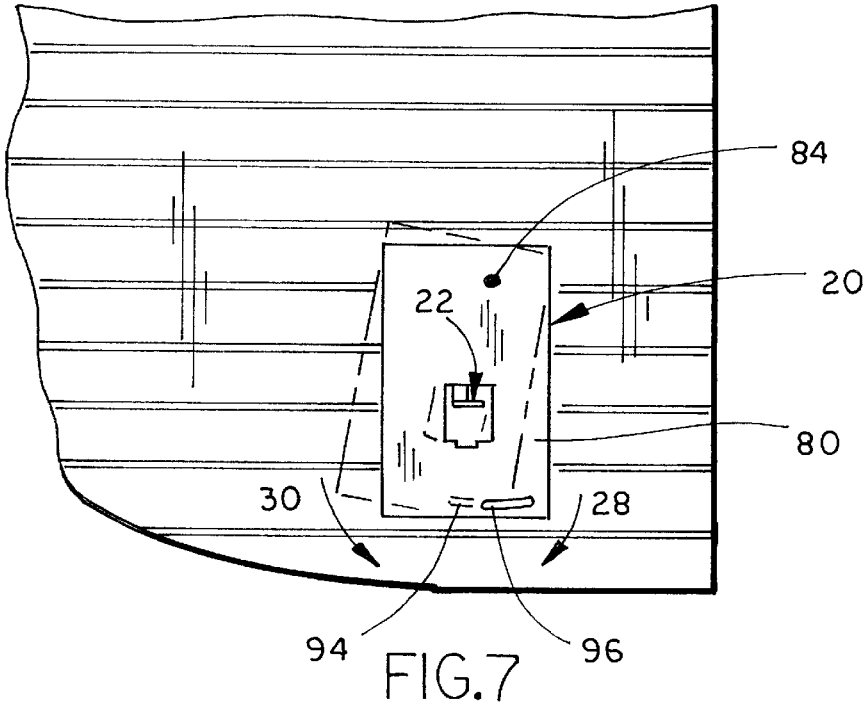
FIG. 7 is a rear view of the cover member embodying the present invention.

The reference number 10 (FIG. 1) generally designates a partition panel 10 embodying the present invention. In the illustrated example, a partition panel includes a frame 12 having at least one slotted frame cross-member 14, a cover member 16, a lock mechanism 18 including a pivoting lock member 20, and a connecting member 84. The cover member 16 has a rear surface 26, and is configured to enclose at least a portion of the frame 12. The pivoting lock member 20 has a protruding lock tab 22 shaped for reception in an associated slot 24 in the frame cross-member 14. The connecting member 84 rotatably connects the lock member 20 to a surface of the cover member 16 in a manner which permits the lock member 20 to be rotated about a center of rotation 82 between an insertion position (dotted line in FIG. 7) wherein the lock tab 22 is in registry with the cross-member slot 24 and an engaged position (solid lines in FIG. 7) wherein the lock tab 22 is engaged with the frame cross-member 14 to positively yet removably lock the cover member 16 on the frame 12. The partition 10 is configured such that the lock tab 22 has a smaller lateral displacement from the center of rotation 82 of the pivoting lock member 20 in the engaged position than in the insertion position.

Figure 8:
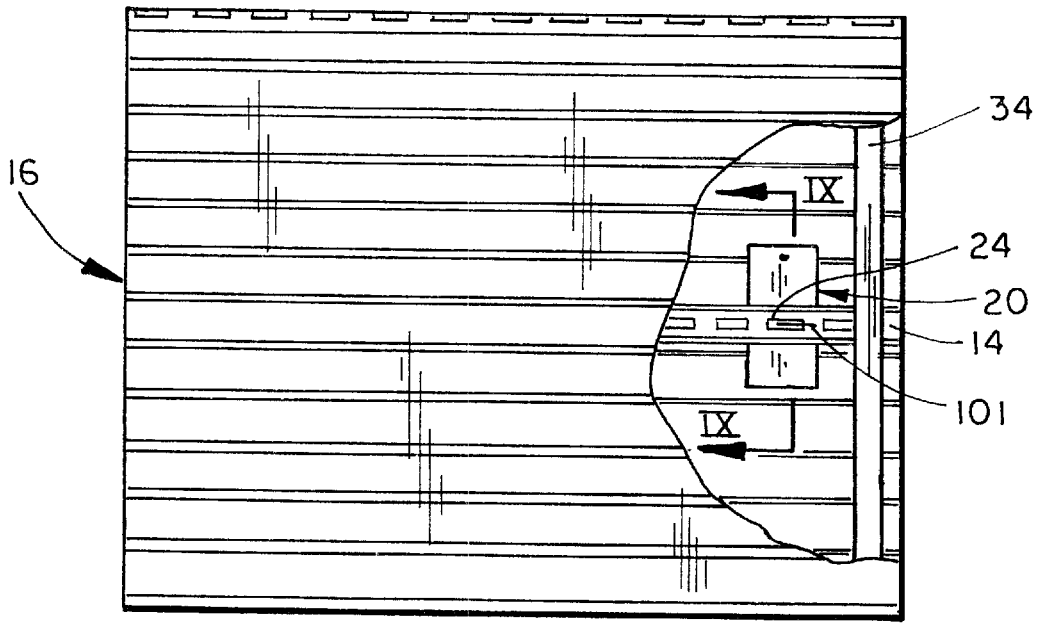
FIG. 8 is a fragmentary view of two cover members locked to the partition panel embodying the present invention.

The illustrated frame 12 (FIG. 1) includes a lower horizontal cross-member 31, the slotted frame cross-member 14, a top horizontal cross-member 32 and two uprights 34. A foot cross-member (not shown) supports the two uprights 34 in a vertical direction. The two uprights 34 support the lower cross-member 31, the slotted frame cross-member 14 and the top horizontal cross-member 32 from the bottom to the top of the uprights 34, respectively. The lower horizontal cross-member 31 is tubular and attached to the two uprights 34. The lower horizontal cross-member 31 defines an upwardly facing channel 38, outboard side faces 40 with slots 42 therein, and angled reinforcement flanges 44 and 45 that extend downwardly to sides of the uprights 34. The two uprights 34 extend through opposite ends of the lower cross-member 31. In the illustrated example, the slotted frame cross-member 14 includes two substantially U-shaped members 46 attached to opposite sides of the two uprights 34 such that the open sides of the two substantially U-shaped members 46 face each other. The top cross-member 32 is located at the top of the two uprights 34 and is identical to the lower cross member 31. In the illustrated example, outside faces of the lower horizontal cross-member 31, the slotted frame cross-member 14 and the top horizontal cross-member 32 define a vertical plane. It is noted that the frame 12 described above is the subject matter of commonly assigned U.S. Pat. No. 5,746,035, hereby incorporated by reference. It is contemplated, however, that the frame 12 could have any configuration, as long as the frame 12 includes the slotted frame cross-member 14. Preferably, the frame 12 includes cover members 16 on each side of the frame 12 (see FIG. 8).

Figure 2:
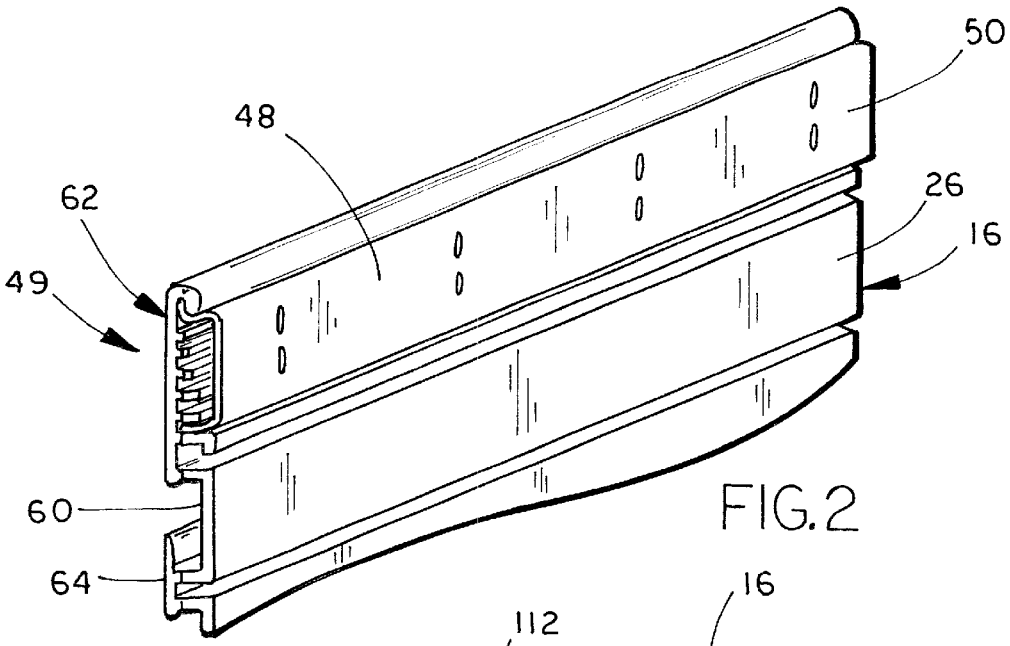
FIG. 2 is a fragmentary perspective view of the top of the cover member and a two-piece hinge of the partition panel embodying the present invention.
Figure 3:
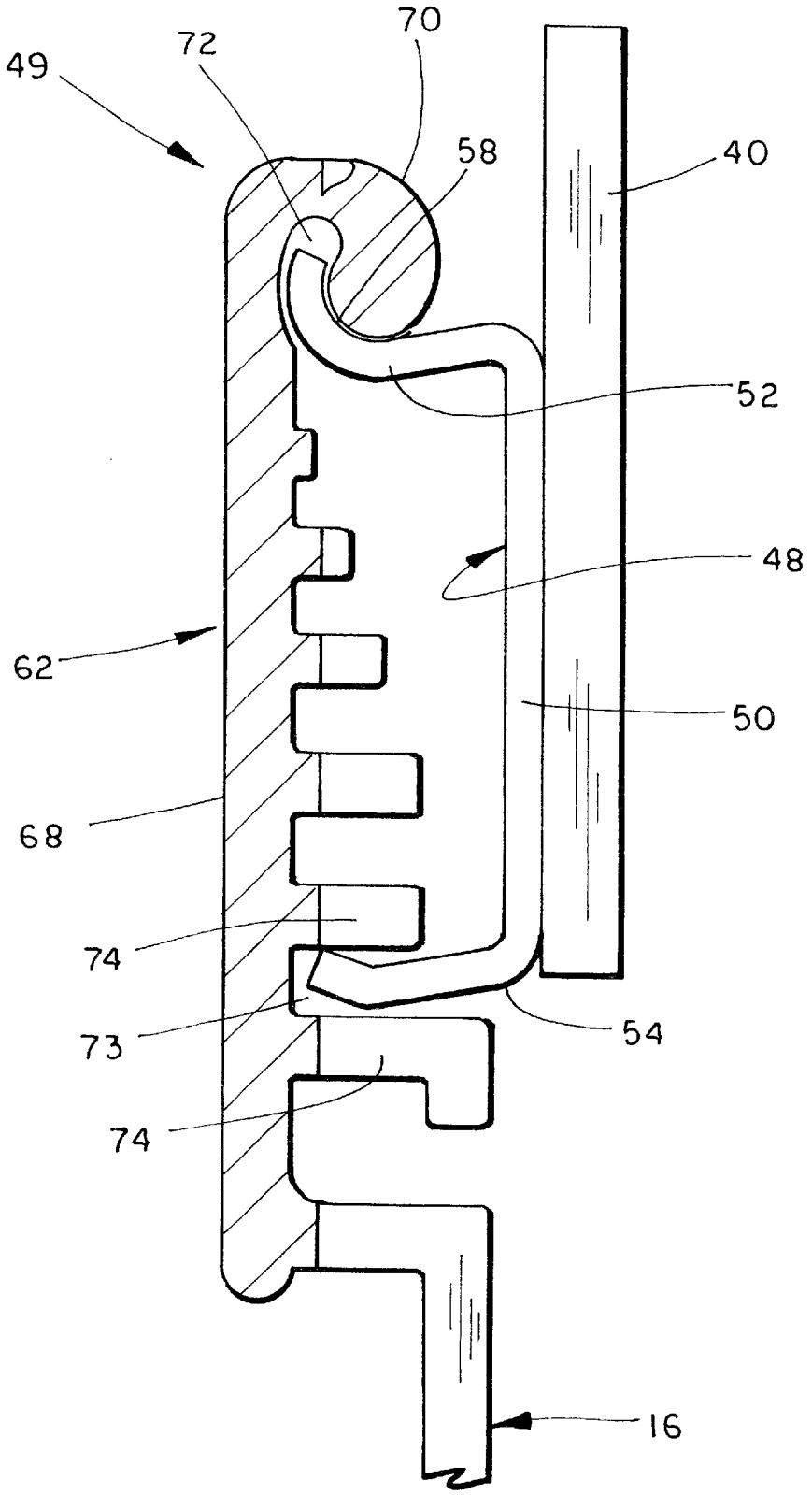
FIG. 3 is a fragmentary side view of the two-piece hinge in a closed position embodying the present invention.
Figure 4:
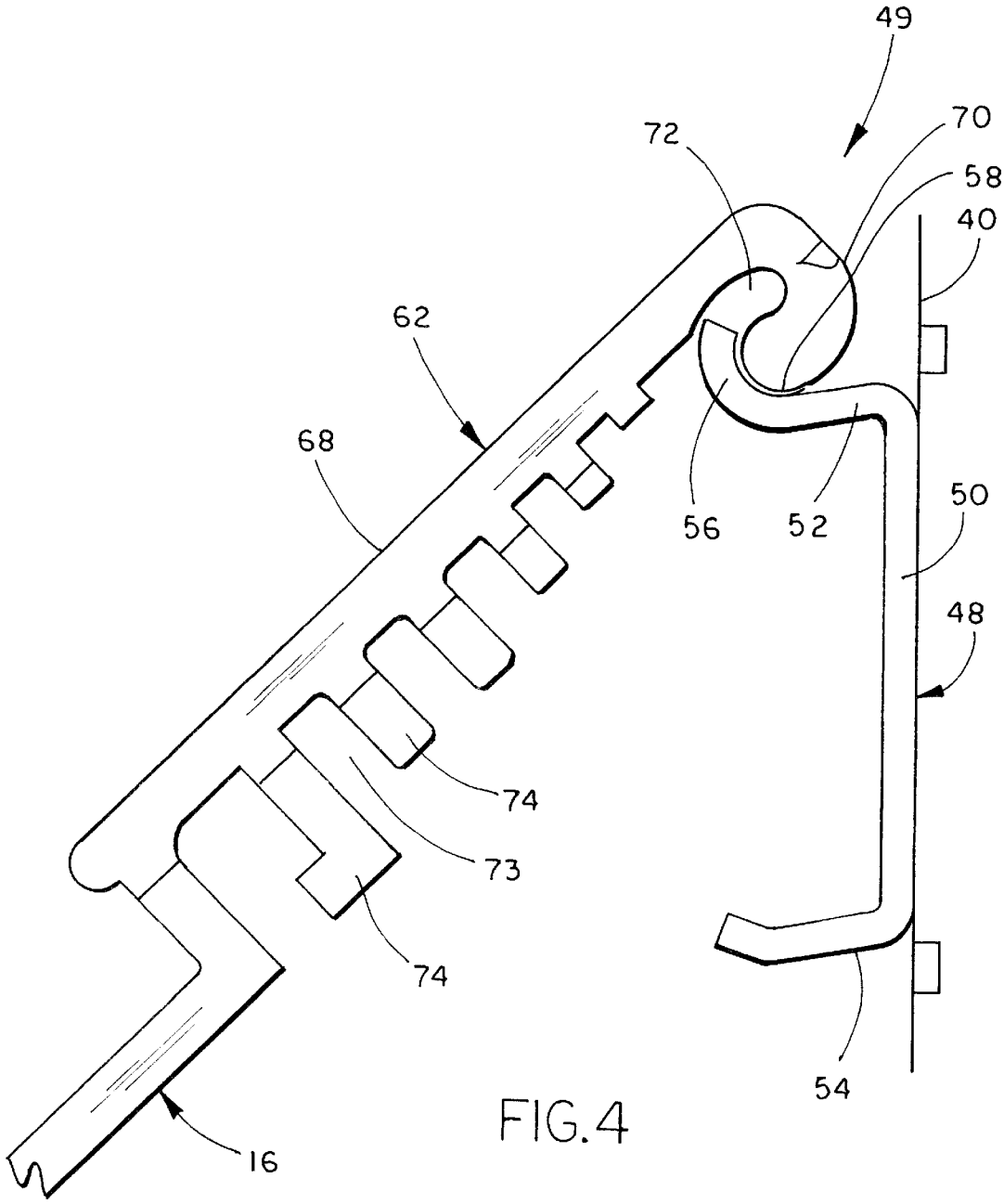
FIG. 4 is a fragmentary side view of the two-piece hinge in an open position embodying the present invention.

In the illustrated example, a two-piece hinge 49 (FIGS. 2–4) rotatably attaches the cover member 16 to the frame 12. The two-piece hinge 49 includes a hinge 48 connected to the top horizontal cross-member 32 and an upper hinge portion 62 on the cover member 16. The hinge 48 includes a flat panel 50 that engages one of the outboard side faces 40 of the top horizontal cross-member 32, an upper curled flange 52 and a lower stabilizing flange 54. The upper curled flange 52 extends laterally from the top of the flat panel 50 and includes an upwardly curved end section 56 defining a top curved surface 58 of the hinge 48. The lower stabilizing flange 54 projects laterally from the bottom edge of the flat panel 50. As described in more detail below, the stabilizing flange 54 is accepted within the cover member 16 and helps to keep the cover member 16 connected to the frame 12.

Figure 5:
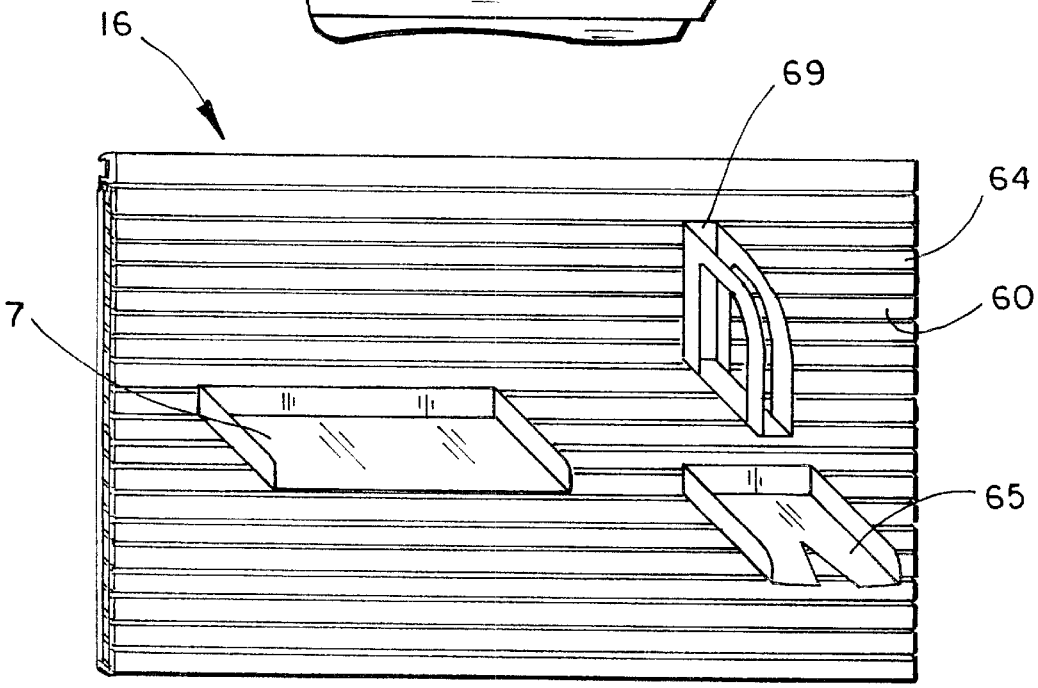
FIG. 5 is a perspective view of the front of the cover member embodying the present invention.

The illustrated cover member 16 (FIGS. 2 and 5) includes a front surface 60, the rear surface 26 and the upper hinge portion 62. The front surface 60 of the cover member 16 includes a plurality of mutually spaced horizontal slats 64 having an L-shaped cross-section. As seen in FIG. 5, the slats 64 can be used for hanging or attaching different implements to the front surface 60 of the cover member 16. For example, the slats can be used for paper trays 65, large trays 67 or book holders 69. As discussed in more detail below, the rear surface 26 of the cover member 16 includes the lock mechanism 18. The upper hinge portion 62 rotatably connects the cover member 16 to the hinge 48 attached to the frame 12 and extends along the top of the cover member 16. The outer hinge portion 62 includes an L-shaped section 68 that extends first outwardly and then upwardly from the top of the cover member 16. The upper hinge portion 62 also includes a curled finger 70 extending rearwardly and downwardly from the top of the L-shaped section 68. The top of the L-shaped section 68 and the curled finger 70 define a space 72 for slidingly rotatingly receiving the curled flange 52, forming the two-piece hinge 49 that can be assembled when the cover member 16 is positioned horizontally and then rotated causing the curled flange to matingly slidingly engage the curled finger 70. The L-shaped section 68 of the outer hinge portion 62 also includes a plurality of laterally extending flanges 74 defining an opening 73 therebetween. When the cover member 16 is moved to a vertical position, the opening 73 defined between the laterally extending flanges 74 receives the stabilizing flange 54 of the hinge 48. The cover member 16 is therefore locked in a vertical position when the cover member 16 is vertical. Alternatively, the cover member 16 could be connected to the frame 12 with a piano hinge. With a piano hinge connecting the cover member 16 to the frame 12, the cover member 16 would be constructed without an upper hinge portion 62. The piano hinge would therefore be screwed to the top of the rear surface 26 of the cover member 16. The piano hinge would also be riveted to the outboard side face 40 of the top cross-member 32 in the same manner of the hinge 48 is connected to the top cross-member 32. It is further contemplated that any hinge connection could connect the cover member to the frame 12. Furthermore, the cover member 16 preferably includes at least one vertically aligned reinforcement bar having a U-shaped cross-section attached to the rear surface 26 of the cover member.

In the illustrated example, the lock mechanism 18 (FIGS. 6–9) includes the pivoting lock member 20 pivotally attached to the rear surface 26 of the cover member 16. Preferably, the cover member 16 includes a lock mechanism 18 adjacent each side of the cover member 16. The pivoting lock member 20 includes a rectangular plate 80 and an aperture 82 near the top of the plate 80 for attachment to the rear surface 26 of the cover member 16. A connecting member 84 is placed through the aperture 82 and into the rear surface 26 of the cover member 16 such that the pivoting lock member 20 is allowed to pivot about the connecting member 84. In the illustrated example, the connecting member 84 is a fastener fixedly connecting the pivoting lock member 20 to the cover member 16. The pivoting lock member 20 has a center of gravity and the aperture 82 is located at a position offset from center of gravity such that the center of gravity forces the plate 80 to rotate until the center of gravity is directly below the aperture 82. The lock tab 22 has an L-shaped configuration and extends from the middle of the plate 80. The lock tab 22 includes a linking portion 86 extending substantially perpendicularly from the plate 80 and a foot portion 88 extending laterally from the linking portion 86. The lock tab 22 is positioned on the rear surface 26 of the cover member 16 such that the foot portion 88 of the lock tab 22 is aligned with the associated slot 24 in the frame cross-member 14. As described in more detail below, the foot portion 88 of the lock tab 22 includes a slanted outer edge 90 whereby the lock tab 22 will pivot when the slanted outer edge 90 abuts the slotted frame cross-member 14.

The illustrated pivoting lock member 20 also includes an arcuate slot 94 that limits the pivotal movement of the pivoting lock member 20. The arcuate slot 94 is located along an arc drawn a predetermined distance from the aperture 82. A pin 96 on the rear surface 26 of the cover member 16 extends through the arcuate slot 94, thereby allowing the pivoting lock member 20 to rotate about the connecting member 84 through the aperture 82 in the plate 80. The arcuate slot 94 has a first end 98 and a second end 100. The first end 98 of the arcuate slot 94 is positioned such that the center of gravity of the pivoting lock member 20 will force the pivoting lock member 20 to rotate in the opposite rotational direction 30 until the pin 96 abuts against the first end 98. In the illustrated example, the first end 98 of the arcuate slot 94 stops the pivotal travel of the pivoting lock member 20 when the foot portion 88 of the lock tab 22 is substantially horizontal and aligned for engagement with the associated slot 24 of the frame cross-member 14. The second end 100 of the arcuate slot 94 stops the pivotal travel of the pivoting lock member 20 when the foot portion 88 of the lock tab 22 is just inside, but not aligned for engagement with, the associated slot 24 of the frame cross-member 14. Without the second end 100 of the arcuate slot 94, the pivoting lock member 20 would be able to have a position wherein the foot portion 88 of the lock tab 22 would abut against the frame cross-member 14. Therefore, the arcuate slot 94 is also configured such that the lock tab 22 can rotate between a first position (shown in solid lines in FIG. 7) wherein the foot portion 88 of the lock tab 22 is engaged with the associated slot 24 in the frame cross-member 14 and a second position (shown in dashed lines in FIG. 7) wherein the foot portion 88 of the lock tab 22 is slightly outside a side wall 101 of the associated slot 24.

The cover member 16 is removably attached to the frame 12 by first engaging the upper hinge portion 62 with the hinge 48 connected to the top horizontal cross-member 32 of the frame 12. The cover member 16 is thereby allowed to rotate about the top horizontal cross-member 32. As the cover member 16 is rotated towards the slotted frame cross-member 14, the pivoting lock member 20 abuts against the slotted frame cross-member 14. The slanted outer edge 90 of the lock tab 22 of the pivoting lock member 20 then forces the pivoting lock member 20 to rotate in the first rotational direction 28 until the foot portion 88 of the lock tab 22 is aligned with and in registry with the associated slot 24 of the frame cross member 16. Therefore, as the cover member 16 is shifted into engagement with the frame 12, the lock tab 22 abuts the frame cross-member 14 to pivot the lock member 20 in a first rotational direction 28 (see FIG. 7) until the lock tab 22 is in registry with the cross-member slot 24. The cover member 16 is thereafter allowed to rotate further until the foot portion 88 of the lock tab 22 is entirely within the associated slot 24. Gravitational forces will thereafter pivot the lock member 20 back in an opposite rotational direction 30 (see FIG. 7) to connect the lock tab 22 with the frame cross-member 14 to positively yet removably lock the cover member 16 on the frame 12. The pivoting lock member 20 can subsequently be disengaged from the frame cross-member 14 by rotating the pivoting lock member 20 in the first rotational direction 28 and disconnecting the lock tab 22 from the frame cross-member 14. The pivoting lock member 20 therefore positively yet removably locks the cover member 16 on the frame 12 to enclose a portion of the frame 12 when the lock tab 22 is connected with the frame cross-member 14.

Figure 10:
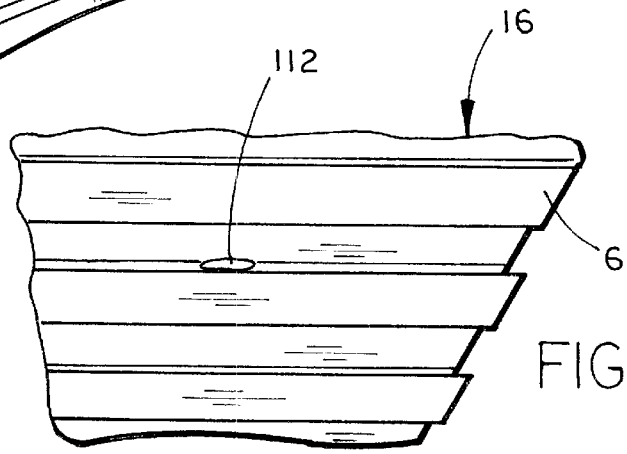
FIG. 10 is a top perspective view of a fragment of the cover member having an opening embodying the present invention.
Figure 6:
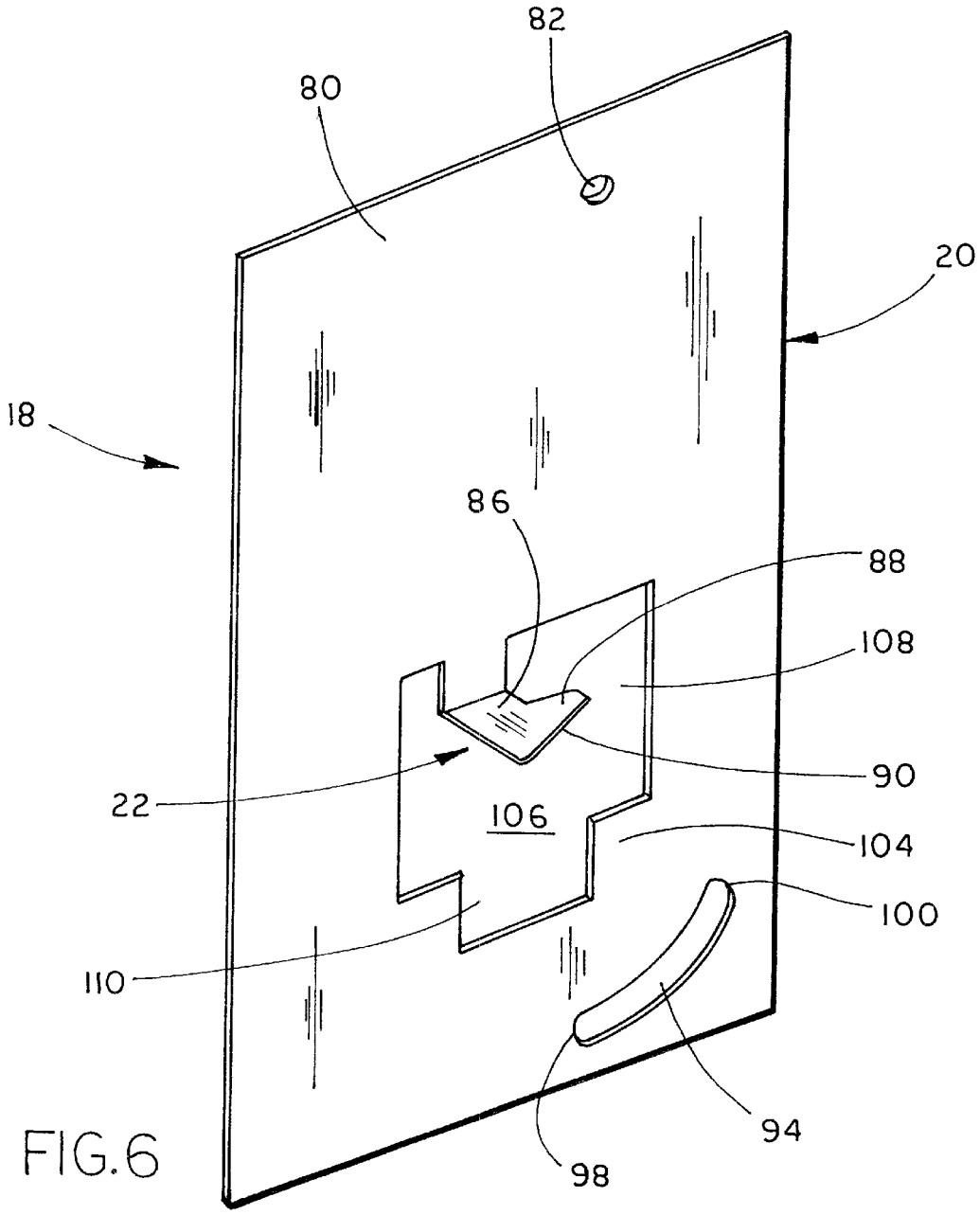
FIG. 6 is a perspective view of a pivoting lock member embodying the present invention.
Figure 9:
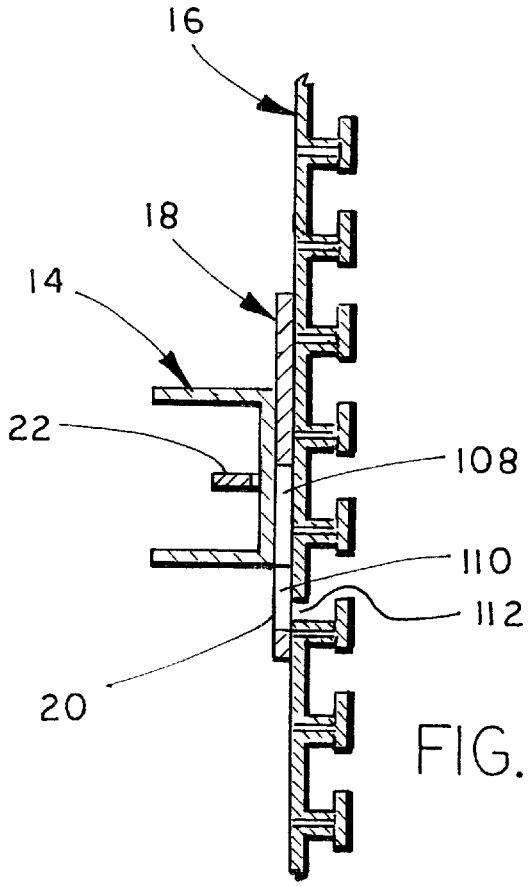
FIG. 9 is a side view of the cover member locked to the partition panel embodying the present invention.

The illustrated pivoting lock member 20 also includes an abutment flange 104 (see FIG. 6) configured to allow the pivoting lock member 20 to disengage from the frame 12. As seen in FIG. 6, the plate 80 of the pivoting lock member 20 includes a hole 106 through the plate 20 below the lock tab 22. The hole 106 includes a central rectangular portion 108 and a small rectangular portion 110 extending from the lower end of the central rectangular portion 108. The abutment flange 104 is located on the plate 80 and defines the side walls of the small rectangular portion 110 of the hole 106. As seen in FIGS. 9 and 10, the cover member 16 includes an access window 112 located between two of the horizontal slats 64. The access window 112 is aligned with the abutment flange 104 such that a tool, like a pencil, can be inserted through the access window 112 from the front surface 60 of the cover member 16 to engage the abutment flange 104. The tool can thereafter push the abutment flange 104 and rotate the pivoting lock member 20 in the first rotational direction 28 such that the lock tab 22 is no longer connected to the frame cross-member 14. The cover member 16 can therefore be rotated away from the frame cross-member 16, thereby disengaging the cover member 16 from the frame cross-member 14. The access window 112 in the cover member 16 is preferably located behind one of the slats 64 and between two of the slats such that the access window 112 is not visible along a line of sight which is substantially perpendicular to the front surface 60 of the cover member 16.

Figure 13:
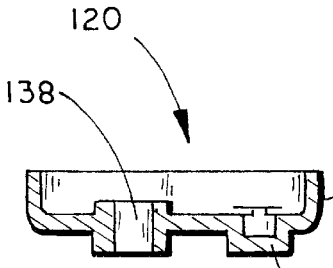
FIG. 13 is a cross-sectional view of a height adjustment device of the second embodiment of the locking mechanism embodying the present invention.

The reference numeral **18*a* (FIGS. 11–13) generally designates another embodiment of the present invention, having a second embodiment for a locking mechanism. Since locking mechanism 18*a* is similar to the previously described locking mechanism 18, similar parts appearing in FIGS. 1–10 and FIGS. 11–13, respectively, are represented by the same, corresponding reference number, except for the suffix "a" in the numerals of the latter. The locking mechanism 18*a* is comprised of a pivoting lock member 20*a*** having a lock tab 22*a*. The locking mechanism 18*a* includes a pair of frictional member 122 for holding the locking mechanism 18*a* in position and for accurately locating the slotted frame cross-member 14 relative to the lock tab 22*a*. In the illustrated example, the frictional members 122 are bushings. The locking mechanism 18*a* also includes a connecting member 84*a* having a height adjustment device 120. The height adjustment device 120 allows adjustment of the position of the lock tab 22*a* and limits the potential for misalignment of the lock tab 22*a* and the associated slot 24.

Figure 14:
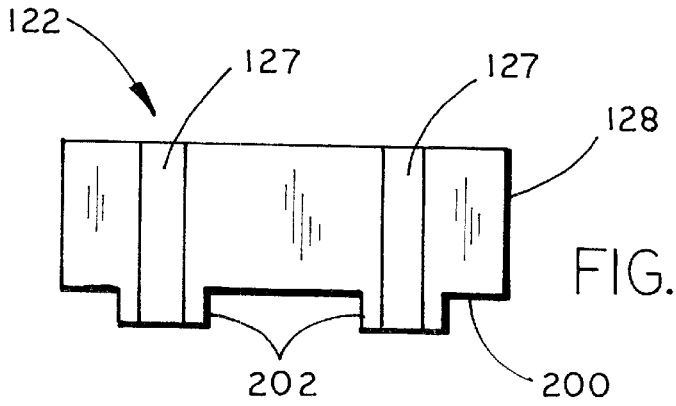
FIG. 14 is a cross-sectional view of a frictional member of the second embodiment of the locking mechanism embodying the present invention.

The illustrated plate 80*a* (FIGS. 11 and 12) includes an aperture 82*a*, a hole 106*a*, an abutment flange 104*a*, an opening 123, an upper alignment arcuate slot 124 and a lower alignment arcuate slot 126. As described below, the plate 80*a* pivots about the aperture 82*a*, and the aperture 82*a* and the opening 123 are used with the height adjustment device 120 for allowing adjustment of the position of the lock tab 22*a* and limiting the potential for misalignment of the lock tab 22*a* and the associated slot 24. The upper alignment arcuate slot 124 is located above the hole 106*a* and the lower alignment arcuate slot 126 is located below the hole 106*a*. The pair of bushings 122 extend from the rear surface 16 of the cover member 16 through the upper alignment arcuate slot 124 and the lower alignment arcuate slot 126. The pair of bushings 122 include a pair of substantially rectangular plates 128 attached by fasteners 130 extending through openings 127 in the plates 128 to the rear surface 26 of the cover member 16. The pair of bushings 122 are similar to the pin 96 and allow the pivoting lock member 20*a* to rotate about the aperture 82*a* in the plate 80. The upper alignment arcuate slot 124 and the lower alignment arcuate slot 126 each have a first end 132 and a second end 134 that function the same as the first end 98 and the second end 100 of the arcuate slot 94 in the first embodiment. Therefore, the upper alignment arcuate slot 124 and the lower alignment arcuate slot 126 are configured such that the lock tab 22*a* can rotate between a first position wherein the foot portion 88*a* of the lock tab 22*a* is engaged with the associated slot 24 in the frame cross-member 14 and a second position wherein the foot portion 88*a* of the lock tab 22*a* is slightly outside a side wall 101 of the associated slot 24. The pair of bushings 122 are also spaced apart such that the bottom edge of the rectangular plate 128 of the pair of bushings 122 in the upper alignment arcuate slot 124 and the top edge of the rectangular plate 128 of the pair of bushings 122 in the lower alignment arcuate slot 126 have a distance between them equal to the vertical height of the slotted frame cross member 14. Therefore, the pair of bushings 122 will accurately locate the slotted frame cross-member 14 between the pair of bushings 122 such that the lock tab 22*a* is aligned with the associated slot 24. A rear surface 200 (FIG. 14) of each of the rectangular plates 128 of the pair of bushings 122 include a pair of bosses 202 through which the fasteners 130 pass. The pair of bosses 202 have a length such that the pivoting lock member 20*a* is allowed to pivot about the bushings 122, but the rear surface 200 abuts against the plate 80*a* of the pivoting lock member 18*a* in order to frictionally hold the pivoting lock member la in a rotated position. Therefore, the tool (not shown) is used to pivot the pivoting lock member 18*a* between the engaged position where the lock tab 22*a* will engage the associated slot 24 to positively yet removably lock the cover member 16 to said frame cross-member 14 and the insertable position where the cover member 16 can be rotated outward relative to the frame cross-member 14. The pivoting lock member 20*a* will therefore be held in the engaged position by a combination of friction and gravitational forces forcing the center of gravity of the pivoting lock member 20*a* to rotate about the pivot point.

Figure 11:
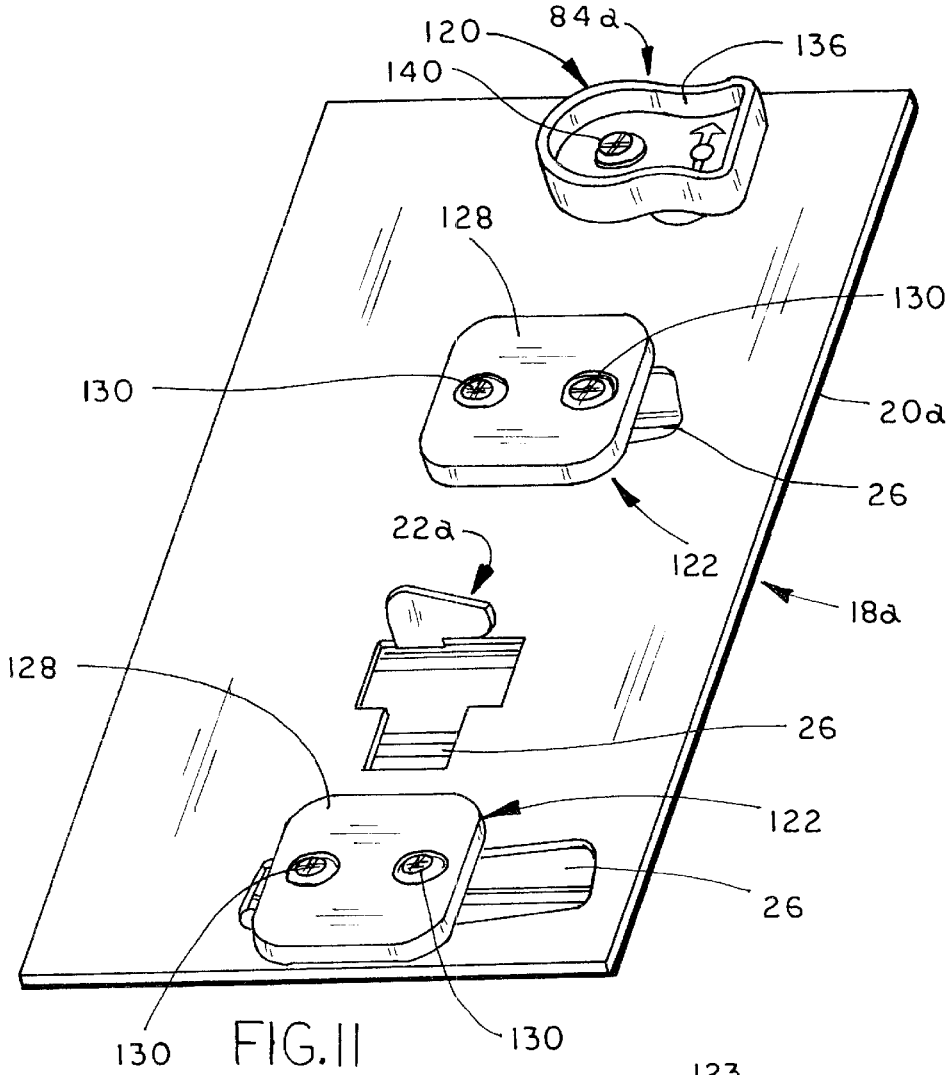
FIG. 11 is a perspective view of a second embodiment of the locking mechanism embodying the present invention.
Figure 12:
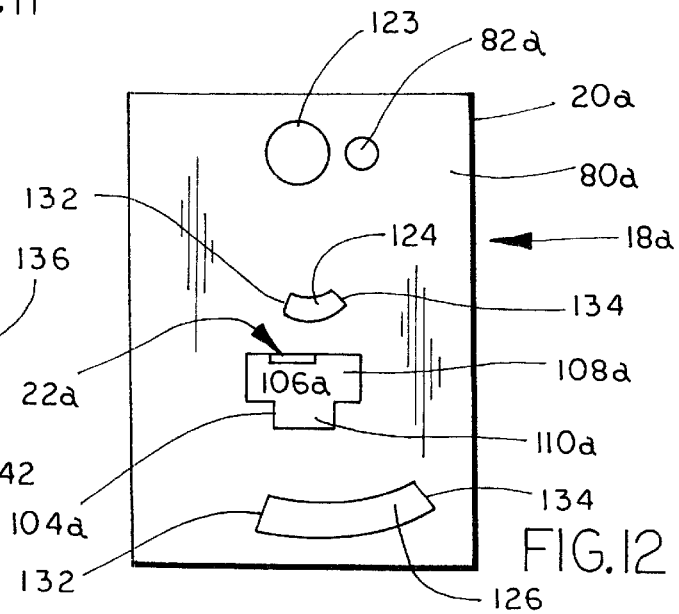
FIG. 12 is a front view of a plate of the second embodiment of the locking mechanism embodying the present invention.

In the illustrated example, the height adjustment device 120 (FIGS. 11 and 13) includes a handle 136 rotatably attached to the rear surface 26 of the cover member 16. The handle 136 includes an opening 138 for accepting a fastener 140 that extends through the opening 123 in the plate 80*a* and fixedly attaches the handle 136 to the rear surface 26 of the cover member 14. The handle 136 also includes a rearwardly extending boss 142 that extends through the aperture 82*a*, thereby allowing rotation of the pivoting lock member 20*a* about the boss 142. As seen in FIG. 11, the opening 138 in the handle 136 and the boss 142 are substantially horizontally aligned, with the opening 138 located to the left of the boss 142. The handle 136 is configured to raise or lower the pivoting lock member 20*a* and the lock tab 22*a* by rotating the handle 136. Because the pivoting lock member 20 rotates about the boss 142, the pivoting lock member 20*a* and the lock tab 22*a* will raise or lower as the boss 142 is raised or lowered, respectively. To raise the pivoting lock member 20*a*, the handle 136 is rotated counterclockwise, thereby raising the boss 142 and the pivoting lock member 20*a*. To lower the pivoting lock member 20*a*, the handle 136 is rotated clockwise, thereby lowering the boss 142 and the pivoting lock member 20*a*. The height adjustment device 120 therefore allows adjustment of the position of the lock tab 22*a* and limits the potential for misalignment of the lock tab 22*a* and the associated slot 24. To facilitate the rotation of the pivoting lock member 20*a*, the opening 123 in the plate 80*a* is larger than the opening 138 for the fastener 140 so that the pivoting lock member 20*a* can rotate about the boss 142 without having the edges of the plate 80*a* surrounding the opening 123 abut the fastener 140 or the walls surrounding the opening 138 in the handle 136.

Although the cover member 16 has been described as being rotatably attached to the top of the frame 12, it is contemplated that the cover member 16 could have other connections to the frame 12. For example, the cover member 16 could be rotatably connected to the bottom of the frame 12 and the cover member 16 rotated upward to engage the pivoting lock member 20 with the frame cross-member 14 to lock the cover member 16 on the frame 12. Likewise, the cover member 16 could include two or more lock mechanisms 18 and the frame 12 could include two or more frame cross members 14 such that the lock mechanisms 18 of the cover member 16 moves directly towards the frame cross members 14 to connect the lock tabs 22 with the frame cross-members 14.

The above description is considered that of the preferred embodiments only. Modification of the invention will occur to those skilled in the art and to those who make or use the invention. For example, a hinge connection between the cover member is not required, as long as the cover member 16 encloses at least a portion of the frame 12 and the lock mechanism 18 removably locks the cover member 16 to the frame 12. Furthermore, the pivoting lock member 20 could include the pair of bushings 122. Moreover, it is contemplated that the lock member 20 could be connected to the cover member 16 other than pivotally. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A lock mechanism for removably attaching a partition cover member to an associated frame having a frame cross-member, comprising:

a pivoting lock member having a protruding lock tab shaped for reception in an associated slot in the frame cross-member; and a connecting member for rotatably connecting said lock member to a surface of the cover member in a manner which permits said lock member to be rotated about a center of rotation between an insertion position wherein said lock tab is in registry with the cross-member slot and an engaged position wherein said lock tab is engaged with the frame cross-member to positively yet removably lock the cover member on the frame; and wherein said lock tab has a center of gravity, and said center of gravity has a smaller lateral displacement to the center of rotation of said pivoting lock member in said engaged position than in said insertion position.

2. The lock mechanism as set forth in claim 1, wherein:

said pivoting lock member further includes a plate; said lock tab being substantially perpendicular to said plate.

3. The lock mechanism as set forth in claim 2, wherein:

said lock tab includes a slanted outer edge whereby said lock tab and said plate will pivot in a first rotational direction when said slanted outer edge engages the frame cross-member.

4. The lock mechanism as set forth in claim 1, wherein:

said pivoting lock member includes an abutment flange configured to accept a tool to disengage said pivoting lock member from the frame cross-member.

5. The lock mechanism as set forth in claim 1, wherein:

said connecting member is configured to allow adjustment of the position of said lock tab and to limit the potential for misalignment of said lock tab and the associated slot.

6. The lock mechanism as set forth in claim 5, wherein:

said connecting member includes a handle adapted to be rotatably attached to the rear surface of the cover member, said handle including a boss; and said pivoting lock member is connected to and rotatable about said boss.

7. The lock mechanism as set forth in claim 1, wherein:

said connecting member comprises a fastener for pivotally attaching the pivoting lock member to the rear surface of the cover member.

8. The lock mechanism as set forth in claim 1, further including:

at least one bushing connected to said cover member and extending through said pivoting lock member;

wherein said at least one bushing frictionally holds said pivoting lock member in position.

9. The lock mechanism as set forth in claim 8, wherein:

said pivoting lock member includes an arcuate slot for each bushing;

said at least one bushing being adapted to slide within said arcuate slot for each bushing as said lock mechanism is pivoted.

10. The lock mechanism as set forth in claim 9, wherein:

said at least one bushing accurately locates the slotted frame cross-member relative to said lock tab.

11. A lock mechanism for removably attaching a partition cover member to an associated frame, comprising:

a pivoting lock member having a protruding lock tab shaped for reception in an associated slot in a cross-member of the frame;

a connecting member for rotatably connecting said lock member to a surface of the cover member in a manner which permits said lock member to be rotated about a center of rotation between an insertion position wherein said lock tab is in registry with the cross-member slot and an engaged position wherein said lock tab is engaged with the frame cross-member to positively yet removably lock the cover member on the frame; and at least one frictional member configured to be connected to the cover member and extending through said pivoting lock member;

wherein said at least one frictional member frictionally holds said pivoting lock member in position when said lock tab is received with the associated slot in the frame cross-member, thereby connecting said lock tab with the frame cross-member to positively yet removably lock the cover member to the frame cross-member.

12. The lock mechanism as set forth in claim 11, wherein:

said pivoting lock member includes an arcuate slot;

wherein said at least one frictional member is adapted to slide within said arcuate slot as said lock mechanism is pivoted.

13. The lock mechanism as set forth in claim 11, wherein:

said pivoting lock member further includes a plate; said lock tab being substantially perpendicular to said plate.

14. The lock mechanism as set forth in claim 11, wherein:

said pivoting lock member includes an abutment flange configured to accept a tool to disengage said pivoting lock member from the frame cross-member.

15. The lock mechanism as set forth in claim 11, wherein:

said connecting member is configured to allow adjustment of the position of said lock tab and to limit the potential for misalignment of said lock tab and said associated slot.

16. The lock mechanism as set forth in claim 15, wherein:

said connecting member includes a handle rotatably adapted to be attached to the rear surface of the cover member, said handle including a boss; and said pivoting lock member is connected to and rotatable about said boss.

17. A partition for spatially dividing open building space and the like, comprising:

a frame having at least one slotted frame cross-member;

a cover member having a rear surface, and being configured to enclose at least a portion of said frame;

a pivoting lock member having a protruding lock tab shaped for reception in an associated slot in said frame cross-member; and a connecting member for rotatably connecting said lock member to a surface of said cover member in a manner which permits said lock member to be rotated about a center of rotation between an insertion position wherein said lock tab is in registry with said cross-member slot and an engaged position wherein said lock tab is engaged with said frame cross-member to positively yet removably lock said cover member on said frame; and wherein said lock tab has a smaller lateral displacement from said center of rotation of said pivoting lock member in said engaged position than in said insertion position.

18. The partition as set forth in claim 17, wherein:

said cover member includes a plurality of mutually spaced horizontal slats arranged along a front surface of said cover member to removably support accessories thereon.

19. The partition as set forth in claim 18, wherein:

said cover member includes an opening between two of said horizontal slats adapted to allow a tool to engage said pivoting lock member from said front surface of said cover member and disengage said pivoting lock member from said frame cross-member.

20. The partition as set forth in claim 19, wherein:

said opening is not visible along a line of sight which is substantially perpendicular to said front surface of said cover member.

21. The partition as set forth in claim 17, wherein:

said pivoting lock member further includes a plate; wherein said lock tab is substantially perpendicular to said plate.

22. The partition as set forth in claim 17, wherein:

said pivoting lock member includes an abutment flange, and a tool engages said abutment flange of said pivoting lock member to disengage said pivoting lock member from said frame.

23. The partition as set forth in claim 17, wherein:

said connecting member comprising a height adjustment device configured to allow adjustment of the position of said lock tab and to limit the potential for misalignment of said lock tab and said associated slot.

24. The partition as set forth in claim 23, wherein:

said height adjustment device includes a handle rotatably attached to the rear surface of the cover member, said handle including a boss; and said pivoting lock member is connected to and rotatable about said boss at said location laterally offset from said predetermined center of gravity.

25. The partition as set forth in claim 24, wherein:

said lock member further includes a pair of bushings for accurately locating the slotted frame cross-member relative to said lock tab.

26. The partition as set forth in claim 17, wherein:

said connecting member rotatably attaches said lock member to said rear surface of said cover member at a location laterally offset from said predetermined center of gravity of said lock member.

27. The partition as set forth in claim 26, wherein:

wherein said predetermined center of gravity has a smaller lateral displacement from said location laterally offset from said predetermined center of gravity in said insertion position than in said engaged position.

28. The partition as set forth in claim 17, further including:

at least one bushing connected to said cover member and extending through said pivoting lock member;

wherein said at least one bushing frictionally holds said pivoting lock member in said insertion position and in said engaged position when said lock tab is received with the associated slot in said frame cross-member.

29. The partition as set forth in claim 28, wherein:

said pivoting lock member includes an arcuate slot for each bushing; and said at least one bushing is adapted to slide within said arcuate slot for each bushing as said lock mechanism is pivoted.

30. The partition as set forth in claim 29, wherein:

said at least one bushing accurately locates the slotted frame cross-member relative to said lock tab.

* * * * *

UNITED STATES PATENT AND TRADEMARK OFFICE

CERTIFICATE OF CORRECTION

PATENT NO. : 6,397,534 B1 
DATED : June 4, 2002
INVENTOR(S) : Allen C. Hager et al.

It is certified that error appears in the above-identified patent and that said Letters Patent is hereby corrected as shown below:

Column 4,
Line 33, "aid" should be -- and --.

Column 9,
Line 56, "la" should be -- 18a --.

Signed and Sealed this

Sixth Day of May, 2003

JAMES E. ROGAN
*Director of the United States Patent and Trademark Office*